US009561582B2

(12) United States Patent
Hsu

(10) Patent No.: US 9,561,582 B2
(45) Date of Patent: Feb. 7, 2017

(54) CONNECTOR

(71) Applicant: CHUNG TAAN INDUSTRIAL CO., LTD, Taichung (TW)

(72) Inventor: Chung-Liang Hsu, Taichung (TW)

(73) Assignee: CHUNG TAAN INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 14/875,237

(22) Filed: Oct. 5, 2015

(65) Prior Publication Data

US 2016/0107299 A1 Apr. 21, 2016

(30) Foreign Application Priority Data

Oct. 17, 2014 (TW) ..... 103135965 A

(51) Int. Cl.
*B25B 23/12* (2006.01)
*B25B 23/00* (2006.01)
*B25B 21/00* (2006.01)

(52) U.S. Cl.
CPC ..... *B25B 23/0064* (2013.01); *B25B 23/0035* (2013.01); *B25B 23/12* (2013.01); *B25B 21/00* (2013.01)

(58) Field of Classification Search
CPC .. B25B 23/0064; B25B 23/0035; B25B 23/12; B25B 21/00; B25B 23/141; B25B 23/14
USPC ..... 81/429, 477, 448, 125
See application file for complete search history.

(56) References Cited

U.S. PATENT DOCUMENTS 6,695,321 B2 * 2/2004 Bedi ..... B25B 15/001 279/22
6,722,667 B2 * 4/2004 Cantlon ..... B23B 31/06 279/155
7,096,768 B1 * 8/2006 Chen ..... B25B 23/12 81/125
7,140,817 B1 * 11/2006 Phillips ..... B23B 31/008 144/136.95
7,387,054 B2 * 6/2008 Rajotte ..... B25B 15/001 279/75
7,424,841 B2 * 9/2008 Liu ..... B25B 15/001 279/22
7,581,470 B1 * 9/2009 Huang ..... B25B 23/0035 279/22

(Continued)

*Primary Examiner* — Hadi Shakeri
*Assistant Examiner* — Danny Hong
(74) *Attorney, Agent, or Firm* — Muncy, Geissler, Olds & Lowe, P.C.

(57) ABSTRACT

A connector includes a rod body, at least one detent, an abutting assembly, a first elastic member and a connecting rod. An insertion groove of the rod body has at least one restraining section, at least one radially-enlarged section and a receiving section, and the rod body has at least one through hole communicating with the receiving section. The detent is received in the through hole and partially protrudes into the insertion groove. The abutting assembly is sleeved outside the rod body, and the detent is sandwiched between the abutting assembly and rod body. The first elastic member abuts against the rod body and abutting assembly to bias the abutting assembly toward an abutting position. The connecting rod further includes at least one abutting section protruding radially and an annular groove, and is axially movable relative to the rod body to comoving or idling position.

10 Claims, 8 Drawing Sheets

(56) References Cited

U.S. PATENT DOCUMENTS

| | | | | |
|---|---|---|---|---|
| 7,735,400 | B2 * | 6/2010 | Chen | B25B 15/001 81/429 |
| 7,810,817 | B1 * | 10/2010 | Gao | B23B 31/1071 279/75 |
| 7,913,592 | B2 * | 3/2011 | Hu | B25B 13/481 81/177.85 |
| 8,550,471 | B2 * | 10/2013 | Huang | B23B 31/06 279/22 |
| 8,864,143 | B2 * | 10/2014 | Lin | B25B 23/0035 279/128 |
| 9,101,987 | B2 * | 8/2015 | Cornwell | B23B 31/107 |
| 9,227,309 | B2 * | 1/2016 | Moss | B25B 23/0035 |
| 2006/0022416 | A1 * | 2/2006 | Chen | B23B 31/107 279/74 |
| 2010/0219594 | A1 * | 9/2010 | Nash | B25B 23/0035 279/77 |
| 2011/0023666 | A1 * | 2/2011 | Hsu | B25B 23/0035 81/438 |
| 2013/0220086 | A1 * | 8/2013 | Peters | B23B 31/10 81/451 |

* cited by examiner

CONNECTOR

BACKGROUND OF THE INVENTION

Field of the Invention

The present invention relates to a connector for tool.

Description of the Prior Art

Usually, when a user assembles a material which is soft and easily cracked, such as a wood board or a plastic board, s/he screws a screw into the material with a rotational driving tool to prevent the material from cracking when the material is assembled (for example, a nail is knocked into the wood board).

However, in the prior art, when the screw is screwed into the material with the rotational driving tool, a screw head of the screw is often buried under a surface of the material while the rotational driving tool is still rotating, and the screw head which is buried deep into the material may cause the material to crack or make the surface of the material uneven.

The present invention has arisen to mitigate and/or obviate the afore-described disadvantages.

SUMMARY OF THE INVENTION

The major object of the present invention is to provide a connector, when a rod body of the connector screws an object to be screwed to a configuration face and the configuration face abuts against an abutting assembly of the connector, the rod body of the connector and a connecting rod connected with the rotational driving tool become rotatable relative to each other, and the screw cannot be rotated and screwed into the configuration face.

To achieve the above and other objects, a connector is provided, including a rod body, at least one detent, an abutting assembly, a first elastic member and a connecting rod. Two opposite ends of the rod body are respectively formed with an assembling portion for a tool head to be assembled thereto and an insertion groove. The insertion groove has at least one restraining section and at least one radially-enlarged section which are neighboring to each other and a receiving section, and a smallest radial dimension of the at least one radially-enlarged section is greater than a largest radial dimension of the at least one restraining section. The rod body is formed with at least one through hole which communicates with the receiving section. The at least one detent is received in the at least one through hole and partially projectable into the insertion groove. The abutting assembly and the rod body are positioningly restrained relative to each other, the abutting assembly is sleeved outside the rod body, the at least one detent is sandwiched between the abutting assembly and the rod body, and the abutting assembly is movable relative to the rod body between an abutting position and a releasing position. An inner side of the abutting assembly has a protrusion and a recess. The first elastic member abuts against between the rod body and the abutting assembly and biases the abutting assembly toward the abutting position normally. An end of the connecting rod is adjustably inserted into the insertion groove, and the other end of the connecting rod is for connection with a rotational driving tool. The connecting rod further includes at least one abutting section which is radially protrudes thereon and an annular groove. Each said abutting section is non-round and abuttable against an inner wall of one said restraining section circumferentially, and the connecting rod is axially movable relative to the rod body to a comoving position or an idling position. Wherein, when the abutting assembly is in the abutting position and the connecting rod is in the comoving position, the protrusion abuts against the at least one detent to make the at least one detent partially protrude into the annular groove to restrain the connecting rod from axially moving relative to the rod body, and each said abutting section corresponds to and circumferentially abuts against the inner wall of one said restraining section; when the abutting assembly is in the releasing position and the connecting rod is in the idling position, the recess allows the at least one detent to retreat thereinto, the connecting rod is axially movable relative to the rod body, and each said abutting section corresponds to one said radially-enlarged section so that the connecting rod is rotatable relative to the rod body.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
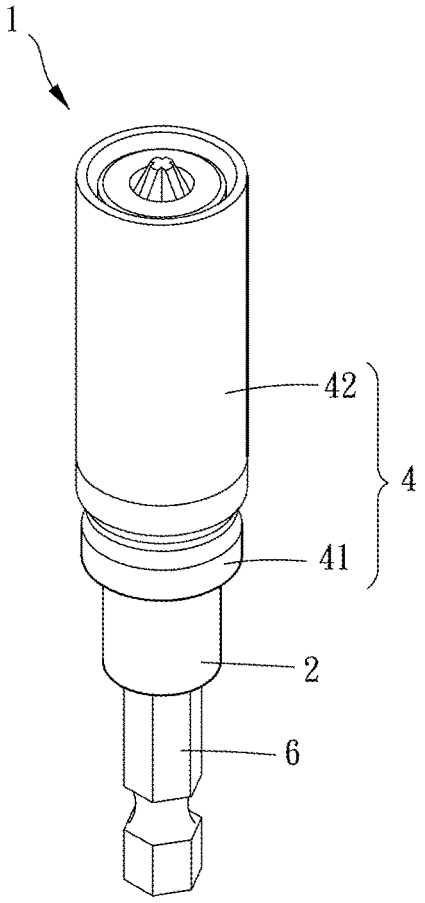
FIG. 1 is a perspective drawing of a preferred embodiment of the present invention.
Figure 2:
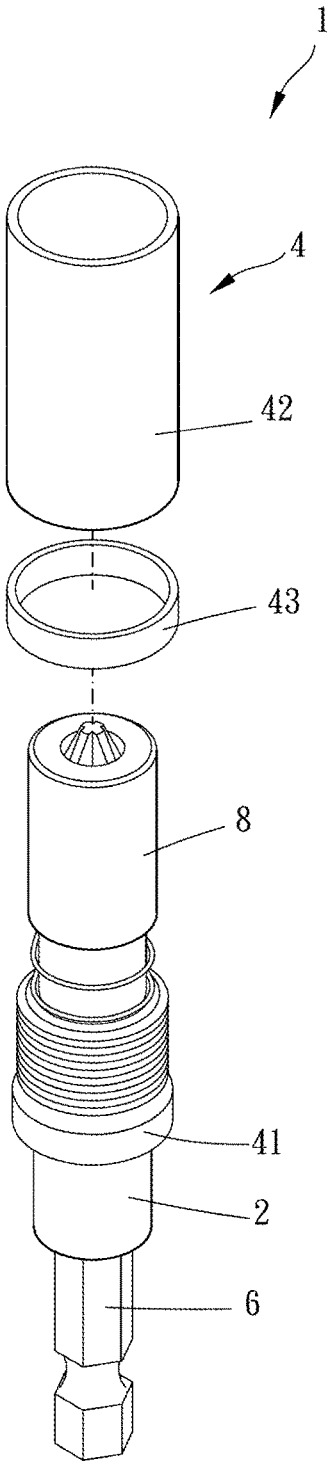
FIG. 2 is a breakdown drawing of the preferred embodiment of the present invention.
Figure 3:
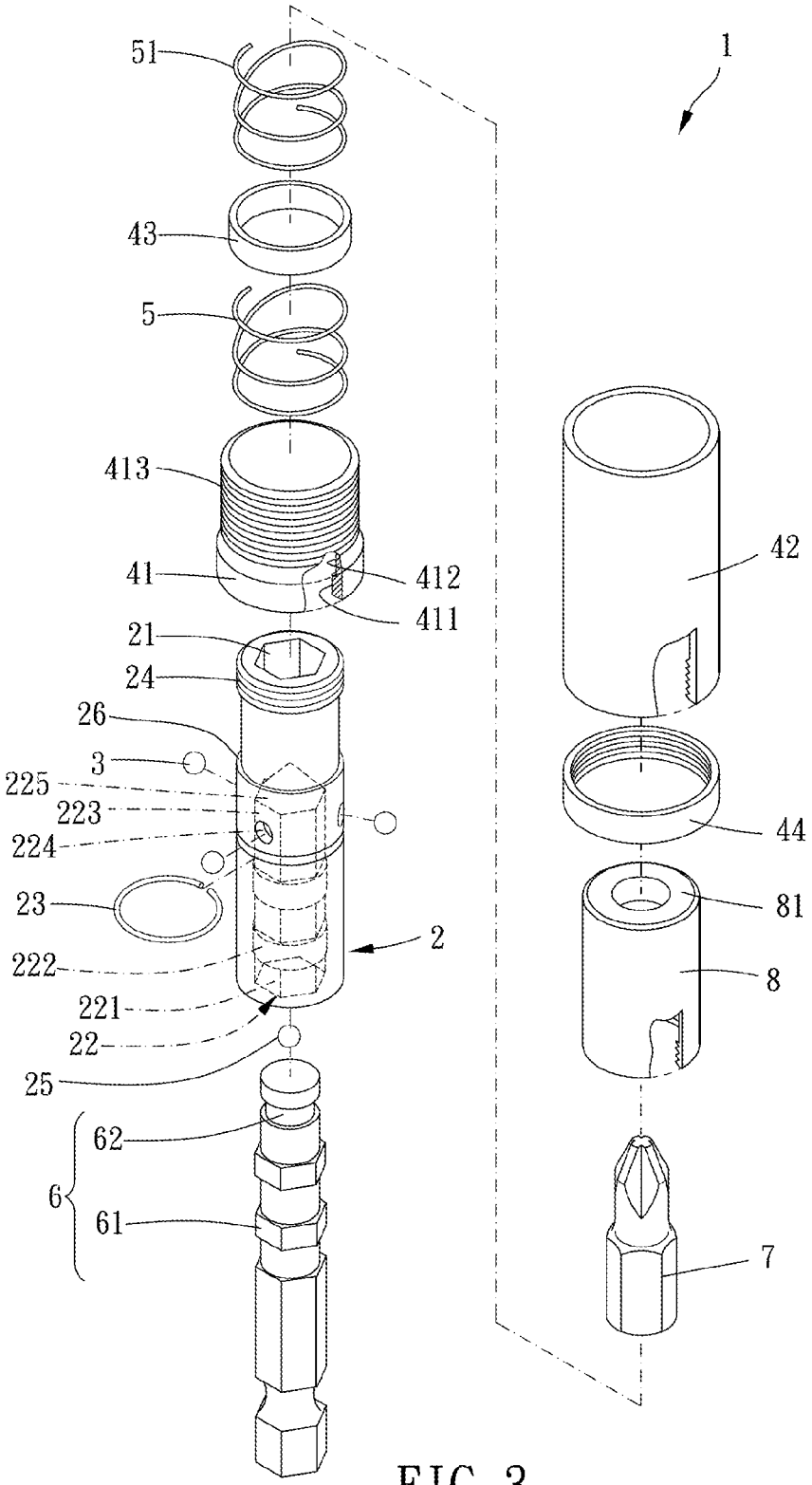
FIG. 3 is another breakdown drawing of the preferred embodiment of the present invention.

Please refer to FIGS. 1 to 3 for a preferred embodiment of the present invention. A connector 1 includes a rod body 2, at least one detent 3, an abutting assembly 4, a first elastic member 5 and a connecting rod 6.

Figure 4:
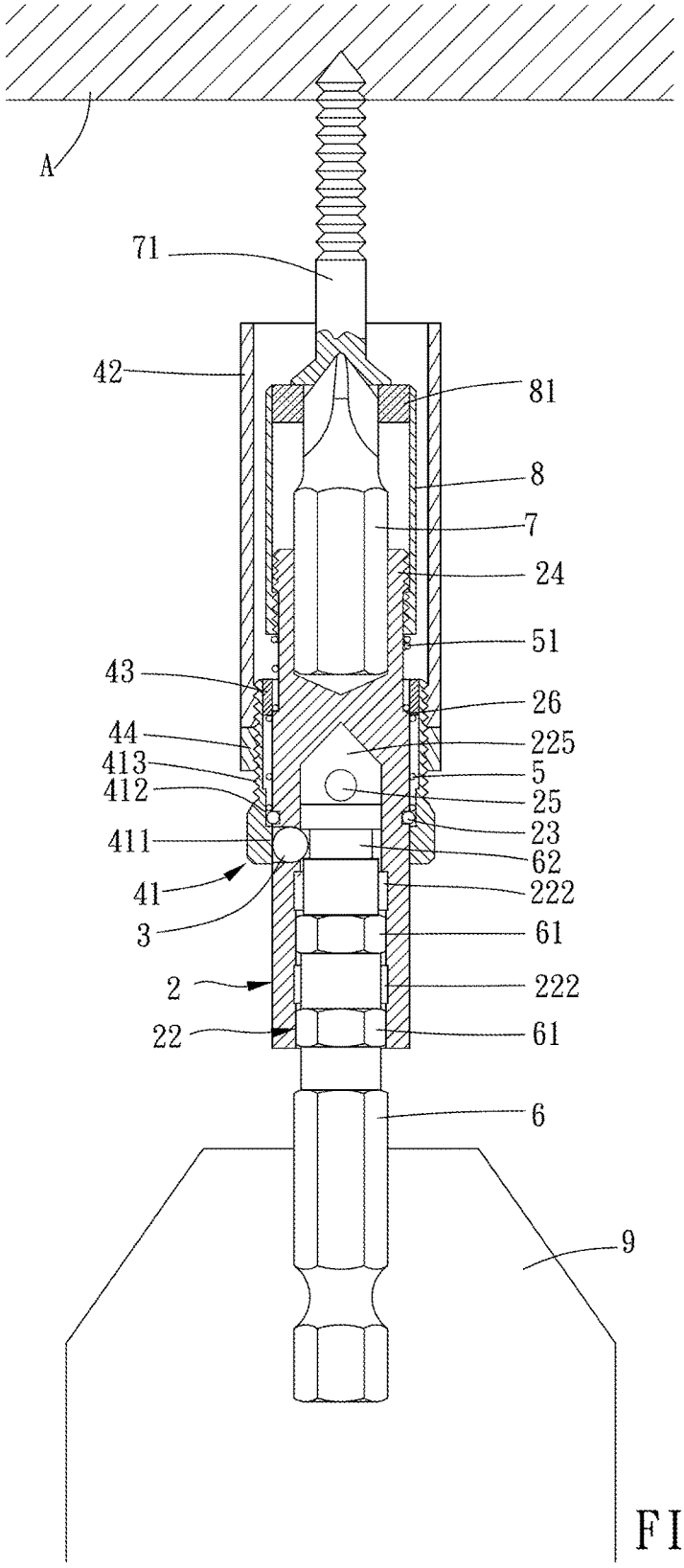
FIGS. 4 to 6 are cross-sectional drawings of the preferred embodiment of the present invention in operation.

Two ends of the rod body 2 are respectively formed with an assembling portion 21 for a tool head 7 to be assembled thereto (as shown in FIG. 4) and an insertion groove 22. The insertion groove 22 has at least one restraining section 221 and at least one radially-enlarged section 222 which are neighboring to each other and a receiving section 223, and a smallest radial dimension of the at least one radially-enlarged section 222 is greater than a largest radial dimension of the at least one restraining section 221. The rod body 2 is formed with at least one through hole 224 which communicates with the receiving section 223, and in this embodiment, a number of the through holes 224 is three. The at least one detent 3 is received in the through holes 224 and partially projectable into the insertion groove 22. A number of the detents 3 corresponds to the number of the through holes 224. In this embodiment, the tool head 7 is a hexagonal screwdriver, and the assembling portion 21 is hexagonal; however, in other embodiments, the tool head and the assembling portion may be in other shapes.

The abutting assembly 4 and the rod body 2 can be positioningly restrained relative to each other, and the abutting assembly 4 is sleeved outside the rod body 2 so that the detents 3 are sandwiched between the abutting assembly 4 and the rod body 2. The abutting assembly 4 is movable relative to the rod body 2 between an abutting position and a releasing position, and an inner side of the abutting assembly 4 has a protrusion 411 and a recess 412. Specifically, in this embodiment, the abutting assembly 4 includes a socket 41 and an abutting member 42, the socket 41 is sleeved outside the rod body 2, an inner side of the socket 41 is formed with the protrusion 411 and the recess 412, an outer side of the socket 41 is provided with a first threaded section 413, an end of the abutting member 42 is axially adjustably screwed to the first threaded section 413 of the socket 41, and a relative position of the abutting member 42 and the socket 41 is adjustable through screwing the abutting member 42 and the socket 41 relative to each other.

The first elastic member 5 abuts against between the rod body 2 and the abutting assembly 4 and biases the abutting assembly 4 toward the abutting position normally. Specifically, the rod body 2 further includes a retaining ring 23, the abutting assembly 4 further includes a loop 43. The retaining ring 23 is arranged around an outer side of the rod body 2, the loop 43 is arranged around the inner side of the abutting assembly 4, the first elastic member 5 abuts against between the retaining ring 23 and the loop 43, and the retaining ring 23 is located between the loop 43 and the protrusion 411 so that the socket 41 is non-disengageable from the rod body 2. In this embodiment, the retaining ring 23 is a C-shaped fastening member; and in other embodiments, the retaining ring 23 may be a round annular fastening member. The loop 43 may also be a C-shaped fastener arranged around the inner side of the abutting assembly 4.

In this embodiment, the connector 1 may further include a surrounding member 8. The surrounding member 8 is axially movably arranged on and slidable relative to the rod body 2, a front end of the socket 8 has a magnetic ring 81 for the tool head 7 to be disposed therethrough so that the magnetic ring 81 of the surrounding member 8 can be used to magnetically suck a screw 71 on the tool head 7 (as shown in FIG. 4) to prevent the screw 71 from falling off. Preferably, a front end of the rod body 2 is provided with a second threaded section 24, a rear end of the surrounding member 8 is screwed to the second threaded section 24, and the surrounding member 8 is positioningly connected to the rod body 2. Specifically, preferably, in this embodiment, the connector 1 may further include a second elastic member 51 which is disposed around the rod body 2, and two ends of the second elastic member 51 respectively abut against the rear end of the surrounding member 8 and a shoulder portion 26 of the rod body 2 to bias the surrounding member 8 toward a front end of the abutting member 42 for sucking the screw 71. In other embodiments, the screw 71 may be other fixing elements.

An end of the connecting rod 6 is adjustably inserted into the insertion groove 22, and the other end of the connecting rod 6 is for connection with a rotational driving tool 9. The connecting rod 6 further includes at least one abutting section 61 which radially protrudes thereon and an annular groove 62. Each said abutting section 61 is non-round and abuts against an inner wall of one said restraining section 221 circumferentially, and the connecting rod 6 is axially movable relative to the rod body 2 to a comoving position or an idling position. Specifically, in this embodiment, the connecting rod 6 includes two said abutting sections 61, the insertion groove 22 includes two said radially-enlarged sections 222 and two said restraining sections 221. Each said abutting section 61 is a polygonal protrusion, and each said restraining section 221 is a polygonal annular recess corresponding to the polygonal protrusion. In this embodiment, each said abutting section 61 is a hexagonal protrusion, and each said restraining section 221 is a hexagonal recess corresponding to the hexagonal protrusion; and in other embodiments, each said abutting section 61 and each said restraining section 221 may be in other shapes.

Figure 5:
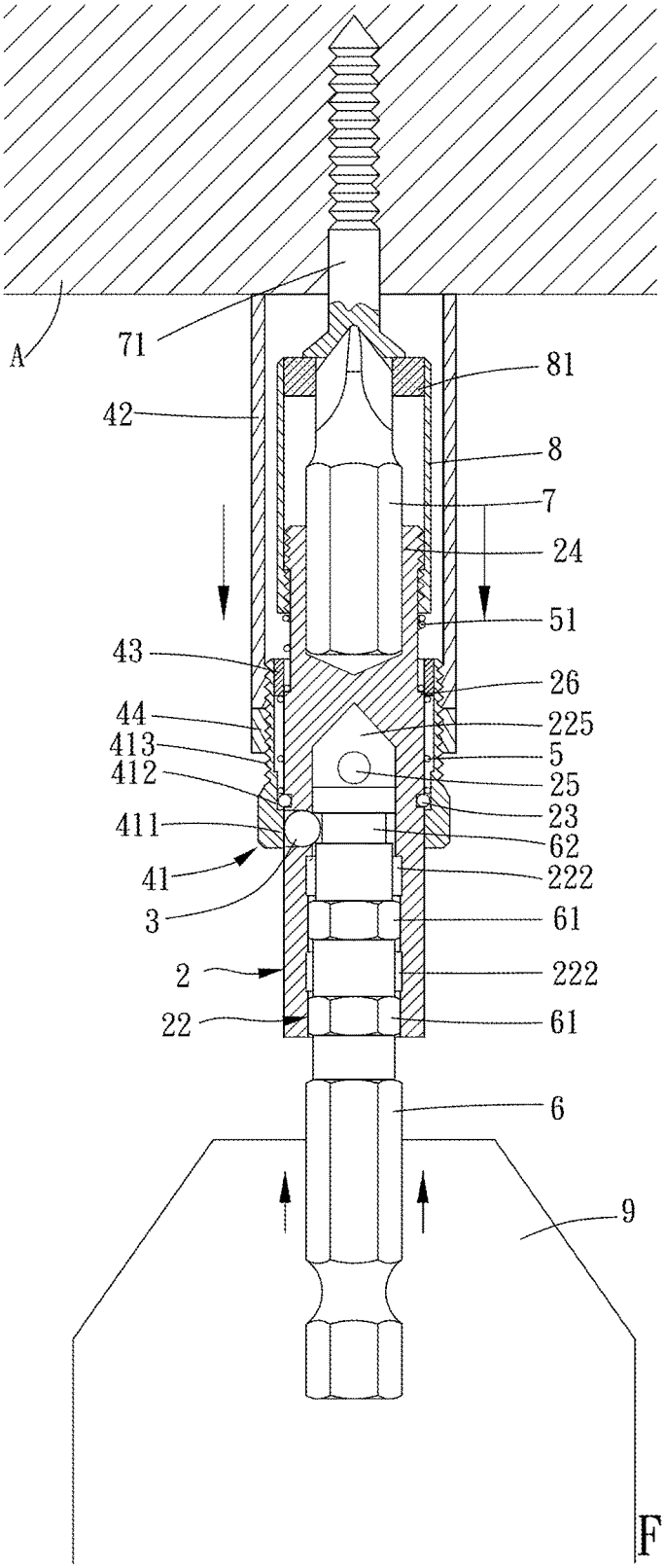
Figure 6:
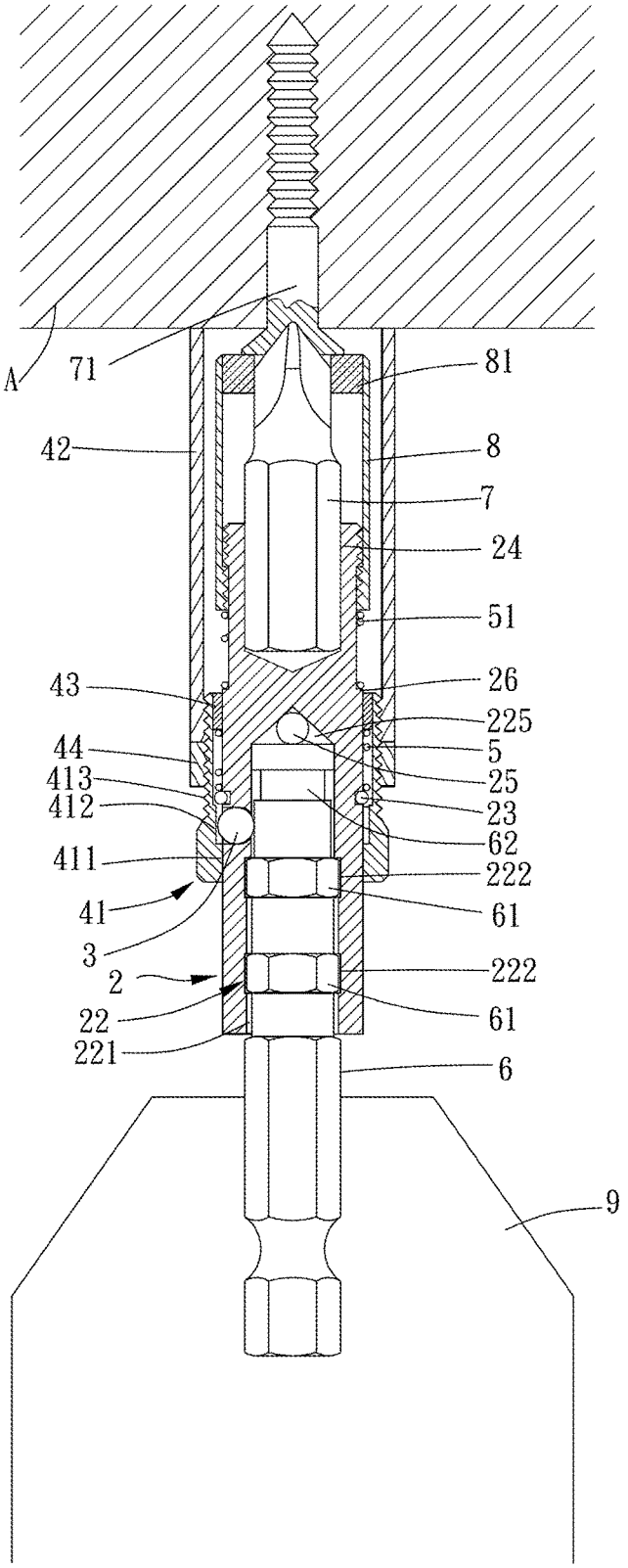

Please further refer to FIGS. 4 to 6. When the abutting assembly 4 is in the abutting position and the connecting rod 6 is in the comoving position (as shown in FIG. 4), the protrusion 411 abuts against the detents 3, and the detents 3 partially protrude into the annular groove 62 to restrain the connecting rod 6 from axially moving relative to the rod body 2, and each said abutting section 61 corresponds to and circumferentially abuts against the inner wall of one said restraining section 221;

when the abutting assembly 4 is in the releasing position and the connecting rod 6 is in the idling position (as shown in FIG. 6), the recess 412 allows the detents 3 to retreat thereinto, the connecting rod 6 is axially movable relative to the rod body 2, and each said abutting section 61 corresponds to one said radially-enlarged section 222 so that the connecting rod 6 is rotatable relative to the rod body 2.

In addition, in actual practice, when the abutting assembly 4 is in the abutting position and the connecting rod 6 is in the comoving position, the rotational driving tool 9 rotates the connecting rod 6. The protrusion 411 abuts against the detents 3, the detents 3 partially protrude into the annular groove 62 to restrain the connecting rod 6 from axially moving relative to the rod body 2, and each said abutting section 61 corresponds to and circumferentially abuts against the inner wall of one said restraining section 221 so that the connecting rod 6 comoves with the rod body 2; therefore, the tool head 7 which is assembled to the assembling portion 21 can drive the screw 71 arranged on the tool head 7 to rotate so as to screw the screw 71 to a configuration face A. When the screw 71 is screwed to the configuration face A and the configuration A abuts against the abutting member 42 of the abutting assembly 4, the configuration A pushes and abuts the abutting member 42 toward the rotational driving tool 9, the rotational driving tool 9 pushes and abuts the connecting rod 6 toward the tool head 7 (as shown in FIG. 5), the abutting assembly 4 is pushed to the releasing position, the detents 3 retreat into the recess 412, the connecting rod 6 is axially movable relative to the rod body 2 to the idling position, each said abutting section 61 moves axially to correspond to one said radially-enlarged section 222 so that the connecting rod 6 is rotatable relative to the rod body 2, the rod body 2 is unrotatable, and the tool head 7 and the screw 71 cannot be rotated nor be screwed into the configuration face A.

It is to be noted that because the abutting member 42 and the socket 41 are screwed to each other, the relative position of the abutting member 42 and the screw 71 may be adjusted by adjusting an axial position of the abutting member 42 to prevent a screw head of the screw 71 from being overly screwed into the configuration face A and from damaging a structure of the configuration face A and cracking of the configuration face A. Preferably, the abutting assembly 4 may further include a positioning member 44, and the positioning member 44 is screwed to the first threaded section 413 and located between the abutting member 42 and the connecting rod 6 to prevent the abutting member 42 form sliding relative to the socket 41 when the abutting member 42 abuts against the configuration face A.

In addition, in this embodiment, the insertion groove 22 may further include a tapered section 225 which is tapered toward a front end of the insertion groove 22, and the tapered section 225 is provided in a front end of the receiving section 223 (as shown in FIG. 3). The insertion groove 22 may further include a rolling ball 25, and the rolling ball 25 is arranged in the tapered section 225. When the connecting rod 6 is in the idling position, the rolling ball 25 abuts against between the tapered section 225 and the connecting rod 6 and point-contacts the connecting rod 6, the tapered section 225 can decrease a friction between the connecting rod 6 and the insertion groove 22; therefore, the connecting rod 6 is rotatable relative to the insertion groove 22, and the connecting rod 6 can be prevented from abutting against an end of the insertion groove 22 and from being abraded. It is noted that in other embodiments, the insertion groove may be provided without the rolling ball, and the connecting rod 6 can still smoothly rotate within the insertion groove.

Figure 7:
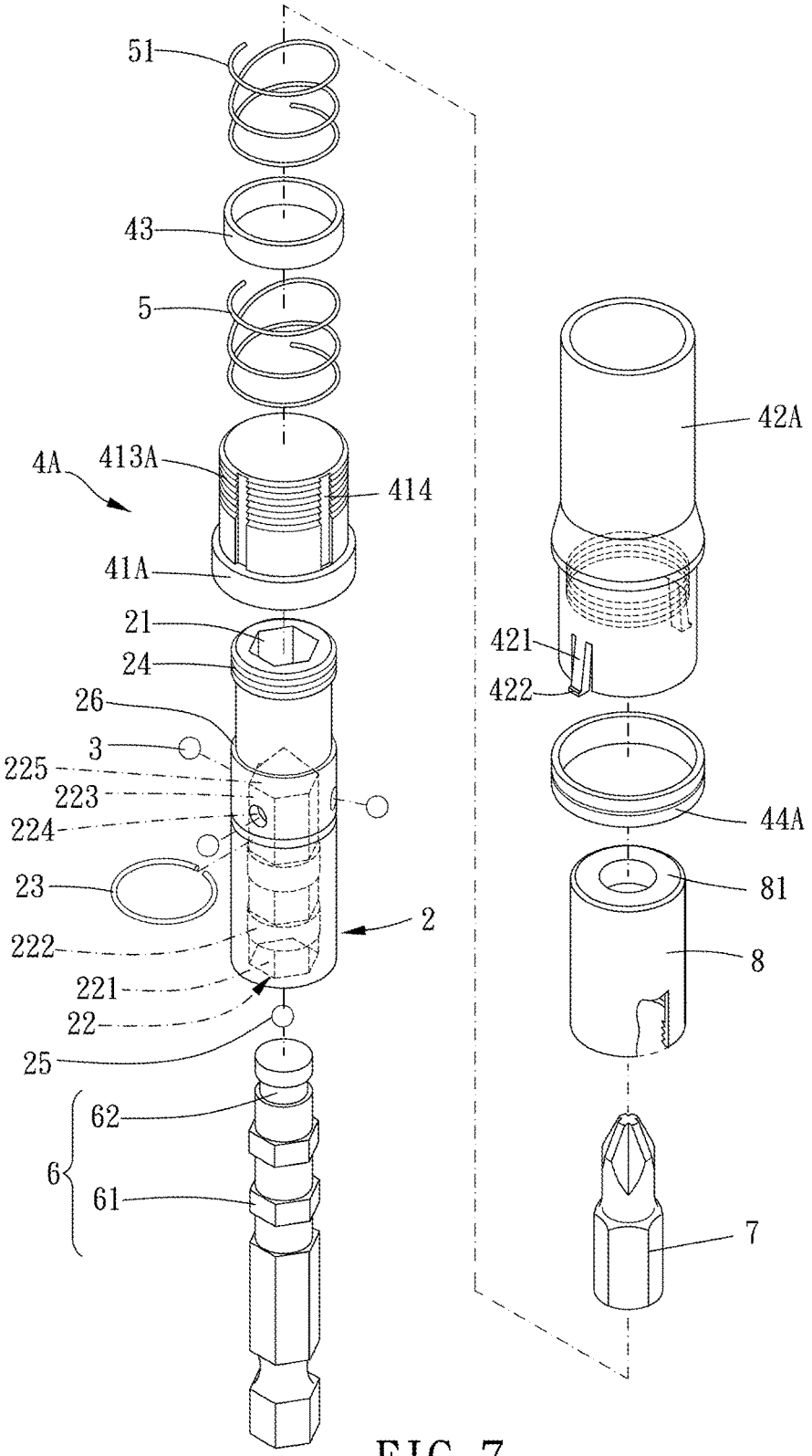
FIG. 7 is a breakdown drawing of another preferred embodiment of the present invention.
Figure 8:
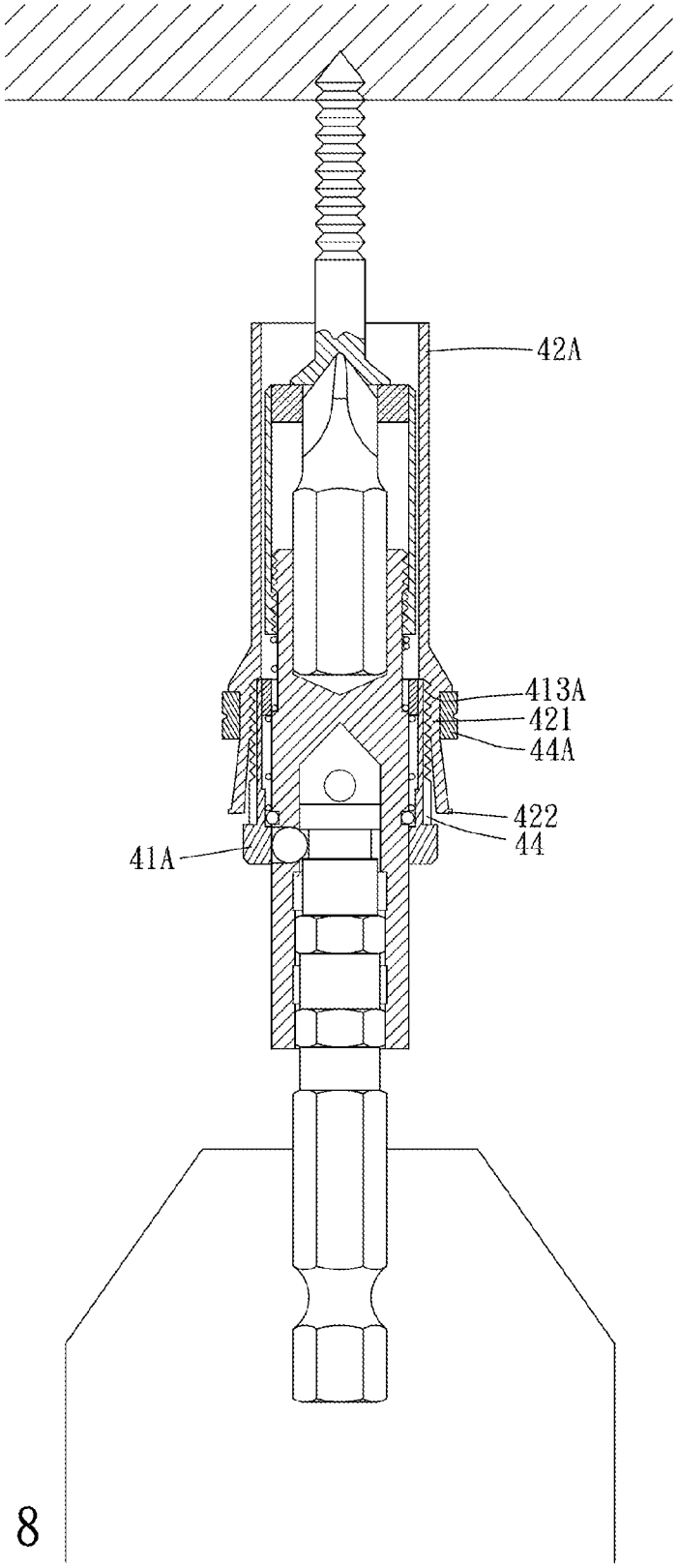
FIGS. 8 and 9 are cross-sectional drawings of another preferred embodiment of the present invention in operation.
Figure 9:
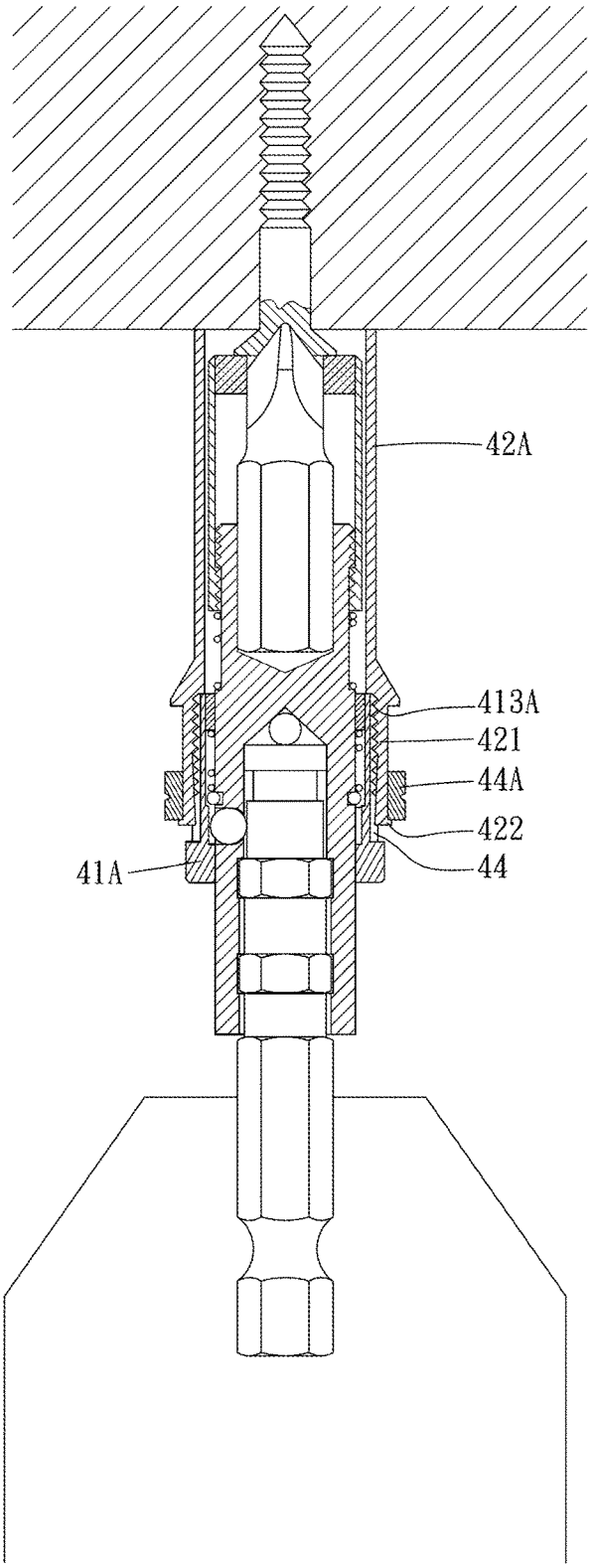

Please further refer to FIGS. 7 to 9 for another embodiment of the present invention. An abutting assembly 4A includes a socket 41A and an abutting member 42A. The socket 41A is sleeved outside the rod body 2, an inner side of the socket 41A has the protrusion 411 and the recess 412, and an outer side of the socket 41A is provided with a first threaded section 413A. An end of the abutting member 42A is axially adjustably screwed to the first threaded section 413A of the socket 41A. The abutting assembly 4A may further include a positioning member 44A, and the positioning member 44A is slidably sleeved to the abutting member 42A. An outer wall of the socket 41A has at least one slot 414 on a direction parallel to an axial direction of the socket 41 A, and a circumferential wall of the abutting member 42A has at least one foot portion 421 which corresponds to the at least one slot 414 in shape. When each said foot portion 421 corresponds to one said slot 414, the positioning member 44A is slidable toward the at least one foot portion 421 to positioningly restrain each said foot portion 421 in one said slot 414, and the abutting member 42A and the socket 41A are non-screwable relative to each other; therefore, the positioning member 44A can prevent the abutting member 42A from sliding relative to the socket 41 A when the abutting member 42A abuts against the configuration face A.

An upper section of an outer side of the socket 41A is provided with the first threaded section 413A, and an lower section of the outer side of the socket 41A is greater than the first threaded section 413A in outer radial dimension so as to effectively positioningly restrain each said foot portion 421. A distal end of each said foot portion 421 has a protrusive portion 422; therefore, when the positioning member 44A slides to the at least one foot portion 421, the protrusive portion 422 of each said foot portion 421 abuts against the positioning member 44A to prevent the positioning member 44A from falling off from the abutting member 42A.

Given the above, when the screw is screwed into the configuration face and the configuration face abuts against the abutting member of the abutting assembly, the abutting assembly is pushed and abutted to the releasing position, the recess allows the detents to retreat thereinto, the connecting rod is axially movable relative to the rod body to the idling position, each said abutting section moves axially to correspond to one said radially-enlarged section so that the connecting rod is rotatable relative to the rod body; therefore, the rod body is unrotatable, and the tool head and the screw cannot be rotated and screwed into the configuration face.

While we have shown and described various embodiments in accordance with the present invention, it should be clear to those skilled in the art that further embodiments may be made without departing from the scope of the present invention.

What is claimed is:

1. A connector, including:

a rod body, two ends of the rod body respectively having an assembling portion for a tool head to be assembled thereto and an insertion groove, the insertion groove having at least one restraining section and at least one radially-enlarged section which are neighboring to each other and a receiving section, a smallest radial dimension of the at least one radially-enlarged section being greater than a largest radial dimension of the at least one restraining section, the rod body formed with at least one through hole which communicates with the receiving section;

at least one detent, received in the at least one through hole and partially projectable into the insertion groove;

an abutting assembly, being positioningly restrained relative to the rod body and sleeved outside the rod body and the at least one detent being sandwiched between the abutting assembly and the rod body, the abutting assembly being movable relative to the rod body between an abutting position and a releasing position, an inner side of the abutting assembly having a protrusion and a recess;

a first elastic member, abutting against between the rod body and the abutting assembly and biasing the abutting assembly toward the abutting position normally;

a connecting rod, an end thereof being adjustably inserted into the insertion groove, the other end thereof for connection with a rotational driving tool, the connecting rod further including at least one abutting section which radially protrudes thereon and an annular groove, each said abutting section being non-round and abuttable against an inner wall of the restraining section circumferentially, the connecting rod being axially movable relative to the rod body to a comoving position or an idling position;

wherein when the abutting assembly is in the abutting position and the connecting rod is in the comoving position, the protrusion abuts against the at least one detent, the detent partially protrudes into the annular groove to restrain an axial movement of the connecting rod relative to the rod body, and each said abutting section corresponds to and circumferentially abuts against the inner wall of one said restraining section; when the abutting assembly is in the releasing position and the connecting rod is in the idling position, the recess allows the at least one detent to retreat thereinto, the connecting rod is axially movable relative to the rod body, and each said abutting section corresponds to one said radially-enlarged section so that the connecting rod is rotatable relative to the rod body.

2. The connector of claim 1, wherein the abutting assembly includes a socket and an abutting member, the socket is sleeved outside the rod body, an inner side of the socket has the protrusion and the recess, an outer side of the socket is provided with a first threaded section, an end of the abutting member is axially adjustably screwed to the first threaded section of the socket, the abutting assembly further includes a positioning member, and the positioning member is screwed to the first threaded section and located between the abutting member and the connecting rod.

3. The connector of claim 2, wherein the rod body further includes a retaining ring, the abutting assembly further includes a loop, the retaining ring is arranged around an outer side of the rod body, the loop is arranged around the inner side of the abutting assembly, the first elastic member abuts against between the retaining ring and the loop, and the retaining ring is located between the loop and the protrusion so that the socket is non-disengageable from the rod body.

4. The connector of claim 1, further including a surrounding member, the surrounding member axially movably arranged on and slidable relative to the rod body, a front end of the surrounding member having a magnetic ring for the tool head to be disposed therethrough; further including a second elastic member disposed around the rod body, two ends of the second elastic member respectively abutting against a rear end of the surrounding member and a shoulder portion of the rod body to bias the surrounding member toward a front end of the abutting member; wherein the front end of the rod body is provided with a second threaded section, the rear end of the surrounding member is screwed to the second threaded section and the surrounding member is positioningly connected to the rod body, each said abutting section is a polygonal protrusion, and each said restraining section is a polygonal annular recess corresponding to the polygonal protrusion.

5. The connector of claim 1, wherein the insertion groove further includes a tapered section tapered toward a front end of the insertion groove, the tapered section is arranged in a front end of the receiving section, wherein the insertion groove further includes a rolling ball, the rolling ball is arranged in the tapered section, when the connecting rod is in the idling position, the rolling ball abuts against between the tapered section and the connecting rod.

6. The connector of claim 1, wherein the abutting assembly includes a socket and an abutting member, the socket is sleeved outside the rod body, an inner side of the socket has the protrusion and the recess, an outer side of the socket is provided with a first threaded section, an end of the abutting member is axially adjustably screwed to the first threaded section of the socket, the abutting assembly further includes a positioning member, the positioning member is screwed to the first threaded section and located between the abutting member and the connecting rod, the rod body further includes a retaining ring, the abutting assembly further includes a loop, the retaining ring is arranged around an outer side of the rod body, the loop is arranged around the inner side of the abutting assembly, the first elastic member abuts against between the retaining ring and the loop, and the retaining ring is located between the loop and the protrusion so that the socket is non-disengageable from the rod body; wherein the connector further includes a surrounding member, the surrounding member is axially movably arranged on and slidable relative to the rod body, a front end of the surrounding member has a magnetic ring for the tool head to be disposed therethrough; the connector further includes a second elastic member disposed around the rod body, two ends of the second elastic member respectively abut against a rear end of the surrounding member and a shoulder portion of the rod body to bias the surrounding member toward a front end of the abutting member; wherein the front end of the rod body is provided with a second threaded section, the rear end of the surrounding member is screwed to the second threaded section and the surrounding member is positioningly connected to the rod body, each said abutting section is a polygonal protrusion, each said restraining section is a polygonal annular recess corresponding to the polygonal protrusion; the insertion groove further includes a tapered section tapered toward a front end of the insertion groove, the tapered section is arranged in a front end of the receiving section, wherein the insertion groove further includes a rolling ball, the rolling ball is arranged in the tapered section, when the connecting rod is in the idling position, the rolling ball abuts against between the tapered section and the connecting rod.

7. The connector of claim 1, wherein the abutting assembly includes a socket and an abutting member, the socket is sleeved outside the rod body, an inner side of the socket has the protrusion and the recess, an outer side of the socket is provided with a first threaded section, an end of the abutting member is axially adjustably screwed to the first threaded section of the socket, the abutting assembly further includes a positioning member, the positioning member is slidably arranged around the abutting member, an outer wall of the socket is formed with at least one slot on a direction parallel to an axial direction of the socket, a circumferential wall of the abutting member is formed with at least one foot portion corresponding to the at least one slot in shape, when each said foot portion corresponds to the slot, the positioning member is slidable toward the at least one foot portion so as to positioningly restrain each said foot portion in one said slot, and the abutting member and the socket are non-screwable relative to each other.

8. The connector of claim 7, wherein an upper section of the outer side of the socket is provided with the first threaded section, and a lower section of the outer side of the socket is greater than the first threaded section in radial dimension.

9. The connector of claim 7, wherein a distal end of each said foot portion has a protrusive portion, and when the positioning member slides to the at least one foot portion, the protrusive portion of each said foot portion abuts against the positioning member.

10. The connector of claim 1, wherein the abutting assembly includes a socket and an abutting member, the socket is sleeved outside the rod body, an inner side of the socket has the protrusion and the recess, an outer side of the socket is provided with a first threaded section, an end of the abutting member is axially adjustably screwed to the first threaded section of the socket, the abutting assembly further includes a positioning member, the positioning member is slidably arranged around the abutting member, an outer wall of the socket is formed with at least one slot on a direction parallel to an axial direction of the socket, a circumferential wall of the abutting member is formed with at least one foot portion corresponding to the at least one slot in shape, when each said foot portion corresponds to the slot, the positioning member is slidable toward the at least one foot portion so as to positioningly restrain each said foot portion in one said slot, and the abutting member and the socket are non-screwable relative to each other; an upper section of the outer side of the socket is provided with the first threaded section, and an lower section of the outer side of the socket is greater than the first threaded section in radial dimension; a distal end of each said foot portion has a protrusive portion, when the positioning member slides to the at least one foot portion, and the protrusive portion of each said foot portion abuts against the positioning member; the rod body further includes a retaining ring, the abutting assembly further includes a loop, the retaining ring is arranged around an outer side of the rod body, the loop is arranged around the inner side of the abutting assembly, the first elastic member abuts against between the retaining ring and the loop, and the retaining ring is located between the loop and the protrusion so that the socket is non-disengageable from the rod body; wherein the connector further includes a surrounding member, the surrounding member is axially movably arranged on and slidable relative to the rod body, a front end of the surrounding member has a magnetic ring for the tool head to be disposed therethrough; the connector further includes a second elastic member disposed around the rod body, two ends of the second elastic member respectively abut against a rear end of the surrounding member and a shoulder portion of the rod body to bias the surrounding member toward a front end of the abutting member; wherein the front end of the rod body is provided with a second threaded section, the rear end of the surrounding member is screwed to the second threaded section and the surrounding member is positioningly connected to the rod body, each said abutting section is a polygonal protrusion, and each said restraining section is a polygonal annular recess corresponding to the polygonal protrusion; the insertion groove further includes a tapered section tapered toward a front end of the insertion groove, the tapered section is arranged in a front end of the receiving section, wherein the insertion groove further includes a rolling ball, the rolling ball is arranged in the tapered section, when the connecting rod is in the idling position, the rolling ball abuts against between the tapered section and the connecting rod.

* * * * *